US012398642B2

(12) United States Patent
Gomez Rojo

(10) Patent No.: US 12,398,642 B2
(45) Date of Patent: Aug. 26, 2025

(54) FULL ROUND TRAVELLING FORMWORK FOR SECONDARY LINING OF TUNNELS

(71) Applicant: GRUPO EMPRESARIAL TECOZAM, S.L, Madrid (ES)

(72) Inventor: Rubén Gomez Rojo, Madrid (ES)

(73) Assignee: GRUPO EMPRESARIAL TECOZAM, S.L, Madrid (ES)

( * ) Notice: Subject to any disclaimer, the term of this patent is extended or adjusted under 35 U.S.C. 154(b) by 224 days.

(21) Appl. No.: 18/031,300

(22) PCT Filed: Oct. 16, 2020

(86) PCT No.: PCT/ES2020/070630
§ 371 (c)(1),
(2) Date: Apr. 11, 2023

(87) PCT Pub. No.: WO2022/079326
PCT Pub. Date: Apr. 21, 2022

(65) Prior Publication Data

US 2023/0417140 A1 Dec. 28, 2023

(51) Int. Cl.
*E21D 11/00* (2006.01)
*E21D 11/10* (2006.01)

(52) U.S. Cl.
CPC ..... *E21D 11/10* (2013.01)

(58) Field of Classification Search
CPC ..... E21D 11/10; E21D 11/102; E21D 11/12
See application file for complete search history.

(56) References Cited

U.S. PATENT DOCUMENTS 1,082,700 A * 12/1913 McArthur ..... E21D 11/102 405/150.1
3,823,566 A * 7/1974 Handewith ..... E21D 23/0095 405/142

(Continued)

FOREIGN PATENT DOCUMENTS

CN 105840212 A * 8/2016
CN 109113765 A * 1/2019 ..... E21D 11/10

(Continued)

OTHER PUBLICATIONS

International Search Report for related PCT patent application PCT/ES2020/070630 prepared by European Patent Office and having a mailing date of Jun. 30, 2021, 4 pgs, in English.

(Continued)

*Primary Examiner* — Benjamin F Fiorello
(74) *Attorney, Agent, or Firm* — Snell & Wilmer LLP

(57) ABSTRACT

A formwork system is specifically adapted to be full-round tunnel lining formwork systems. The system includes at least one formwork element having a surface shaped to conform a part of a tunnel lining, and hydraulic cylinder coupled with the formwork element to exert pressure on it towards a primary lining, and at least one load sensor for measuring load exerted by the hydraulic cylinder. The system further includes a system controller that operates the hydraulic cylinder based on measurements of the pressure sensor, and maintains the pressure exerted by the formwork element on a primary lining during concrete forging, equal or below a predefined pressure to avoid damaging an external tunnel lining or structure. The formwork system speeds up execution work and avoids budget overcost caused by damages and repairs.

16 Claims, 7 Drawing Sheets

(56) References Cited

U.S. PATENT DOCUMENTS

| | | | | | |
|---|---|---|---|---|---|
| 3,851,481 | A | * | 12/1974 | Swoager | E21D 20/003 198/304 |
| 3,885,397 | A | * | 5/1975 | Fujimori | E21D 11/40 405/288 |
| 3,896,629 | A | * | 7/1975 | Stevens | E21D 11/40 405/148 |
| 3,970,200 | A | * | 7/1976 | Goetjen | E21D 11/40 405/148 |
| 5,253,955 | A | * | 10/1993 | Walbrohl | E21D 11/102 264/32 |

FOREIGN PATENT DOCUMENTS

| | | | | | |
|---|---|---|---|---|---|
| CN | 209 976 551 | U | | 1/2020 | |
| CN | 111350526 | A | * | 6/2020 | E21D 11/102 |
| JP | S5199438 | U | * | 8/1976 | |
| JP | 2002220995 | A | | 8/2002 | |
| JP | 2019049156 | A | * | 3/2019 | |

OTHER PUBLICATIONS

Written Opinion of the International Searching Authority for related PCT patent application PCT/ES2020/070630 prepared by European Patent Office and having a publication date of Apr. 21, 2022, 7 pgs, in English.

* cited by examiner

A-A

B-B

FULL ROUND TRAVELLING FORMWORK FOR SECONDARY LINING OF TUNNELS

CROSS-REFERENCE TO RELATED APPLICATIONS

This application is a national stage under 35 U.S.C. § 371 of PCT patent application PCT/ES2020/070630 filed on 16 Oct. 2020, which is pending, which is hereby incorporated by reference in its entirety for all purposes, and to which the present application claims priority.

OBJECT OF THE INVENTION

The invention relates to formwork systems, more specifically to tunnel lining formwork systems.

More particularly, the invention relates to a formwork system, that avoids damages to a primary tunnel lining, during casting of a secondary lining.

Even more particularly, the invention relates to a formwork system, preferably a full round formwork, that speed up execution work and avoids budget overcost caused by damages and repairs.

BACKGROUND OF THE INVENTION

Conventionally, mine tunnels after being formed by a Tunnel Boring Machine (TBM) or by conventional drilling and blasting, are in some cases lined with a plurality of pre-fabricated dowels such that adjacent dowels are bolted to each other to form a tubular structure for the stabilization of the excavation.

For certain applications as for example for sewage collectors that must be watertight, a secondary lining of reinforced concrete, is formed on the dowels structure that provide a watertight lining. For these works, tunnel formworks are used to cast a secondary lining fully covering the primary lining of dowels, wherein the secondary lining is formed in a step by step casting process, during which the formwork is moved to a next casting position one the concrete of a tunnel section has been forged.

For moving a full-round formwork during the step by step casting process, the following rolling solutions are known:

- Self-launching carriages. The carriages are twice as long as the formwork, so that the formwork pulls the carriage and the carriage pulls the formwork.
- Trolleys with double floor. The trolley is a horseshoe trolley that rolls on the slab with integrated rails and is anchored to it before the concrete is poured. A slab of double length to the length of the formwork moves through the trolley-formwork assembly itself, like a worm.
- Trolleys on rails. The equipment is supplied with a set of rails of at least double the length of the trolley, and these rails move through the trolley-formwork assembly.

Other known solutions are: tracked trolleys, trolley with pneumatic tyres and trolleys with solid rubber tyred wheels with steel hubs.

The formwork comprises a plurality of articulated formwork elements, and when it is deployed inside a tunnel an annular gap is formed between the formwork and the primary lining. Then, concrete is injected filling up the gap, and during this process the formwork elements are pressed against the dowels by means of hydraulic cylinders.

However, the construction of secondary reinforced linings in mine tunnels, especially in full-round tunnels, involves substantial difficulties and complexity, that require unique performance of the formwork technology to address particular challengers of some construction works.

In particular, existing full round tunnel formworks even the most advanced on the market, generate many problems like stops, delays in execution, mostly related to damages in the primary lining of dowels, basically because none of the existing tunnel formwork is designed to address the problem of the loads supported by the primary structure, which is sensitive to overpressures at which can be subjected.

Therefore, existing formworks system of this type are known to cause breakage of the waterproofing between the primary dowels lining. This causes many repair works that in turn yields overcosts of the project budget.

Therefore, it has been detected a demand in this technical field for improved full round formwork technology that avoids damages in a previously formed structure in a tunnel, so as to prevent delays in the execution of the work and overcost due to repairs.

SUMMARY OF THE INVENTION

The present invention is defined in the attached independent claim, and satisfactorily solves the drawbacks of the prior art, by providing a formwork system for secondary lining of tunnels in general like: mine tunnels, cut-and-cover tunnels, bored tunnels, etc., that assures that the load transmitted to a primary lining of dowels, is always below a maximum load per dowel.

The invention can be applied for example for the construction of a network of collectors.

Therefore, an aspect of the invention refers to a formwork system for secondary lining of tunnels, comprising at least one formwork element having a surface shaped to conform a part of a tunnel surface, for example a primary lining formed by bolted dowels. The system includes a hydraulic cylinder coupled with the formwork element to exert pressure on it towards a tunnel surface like the primary lining.

The system additional comprises at least one pressure sensor for measuring pressure exerted by the hydraulic cylinder, and a system controller adapted to operate the hydraulic cylinder based on measurements of the pressure sensor. The system controller is adapted to maintain the pressure exerted by the formwork element on a primary lining during concrete forging, equal or below a predefined pressure to avoid damaging the primary lining.

In a preferred application of the invention, the predefined pressure is within the range 40 to 45 Tones.

Preferably, the system includes at least one master cylinder and several associated slave cylinders. The master cylinder intervene first to counteract all the pressure resulting from concreting, such that the primary cylinder comes into contact with a single dowel of the primary lining. As concreting progresses, the pressure in the master cylinder increases, transmitting it to the only dowel on which it is pressing.

To avoid that pressure will exceed the permissible pressure for the dowel, that could break or damage the dowel, the system controller operates the slave cylinders, when a certain pressure is reached in the master cylinder, so that the pressure exerted by the concrete is not only absorbed by the master cylinder, but it is distributed among the master cylinder and as many slaves as necessary so as not to exceed, in any of the dowels on which they rest the maximum admissible, thus avoiding damage in any of them.

Therefore, once the formwork system is positioned at the correct height, the master cylinder contrasts against its support and blocks its position for the rest of the execution process. It is the slave cylinders that prevent overloading the master cylinder by introducing oil into them, thereby relieving pressure in the master cylinder without modifying its extension.

The formwork system further comprises a carriage including a front structure and a rear structure longitudinally aligned, such that each structure has legs provided with wheels arranged for rolling on a surface of a primary lining of a tunnel. In addition, a formwork supporting structure is arranged in between the first and second structures, and it is supported by the first and second structures.

The system incorporates a formwork structure formed by a set of formwork elements, and mounted on the formwork supporting structure. The formwork structure can be retracted and extended, such that when it is extended it has a tubular configuration, preferably a cylindrical configuration for casting a cylindrical lining.

Each of the front and rear structure has at least two legs, preferably four legs, and at least one leg is individually extendable and retractable, by means of the system controller. The system controller is further adapted to maintain the pressure exerted by the legs on a primary lining below the predefined pressure. Therefore, the formwork system has several legs that serve to cope with unevenness of the surface on which the front and rear structures roll.

In addition, each leg is supported on a bogie provided with at least one wheel. In a preferred embodiment, the bogie is a four-wheels bogie, such that each bogie has a front pair of wheels and a rear pair of wheels (behind the front pair in accordance with the displacement direction), and wherein the wheels in each pair are inclined with respect to each other, that is, they are rotatable about different axis.

When the formwork structure is extended, it conforms a cylindrical configuration. Each leg of the system is arranged as a secant line to a circumference defined by the formwork structure when it is extended. The rotation axis of each wheel is inclined with respect to the longitudinal axis of the leg to which it is coupled, in a way that the structures are capable of rolling on a cylindrical surface formed by the primary lining.

With this arrangement of wheels, the loads are introduced in the structure in a radial direction and the distribution of loads is balanced. A result of this, is that the operation of moving the formwork system to one casting position to the next one, is faster than any of the prior art solutions.

In addition, for the structures to be able to properly roll on a cylindrical surface, each four-wheels bogie is configured to have three degrees of freedom, namely freedom of movement along a transversal axis, along a vertical axis, and along a longitudinal axis. The transversal axis freedom allows the system to take slopes, the vertical axis freedom allows to take turns, and the longitudinal axis of freedom allow the 4 wheels of the bogie to rest on the cylindrical surface support when the rolling does not occurs along a generatrix line of the cylinder.

Furthermore, the front and rear structures are provided with a plurality of arched beams mounted at a top part of the structure, for contacting with an upper part of the primary lining. Each arched beam is coupled in an articulated manner with an anti-flotation hydraulic cylinder to press the arched beams against the primary lining, as to withstand flotation loads generated by the concrete while it is being poured in the gap between the formwork and the primary lining. The system controller is further adapted to maintain the load exerted by the anti-flotation hydraulic cylinder, equal or below the predefined pressure.

In a preferred embodiment of the invention, each structure has six arched beams and respective anti-flotation cylinders, and each arched beam has two lateral support shoes that are pivotally mounted in the arched beam, and which are provided for contacting with the primary lining, such that the formwork system would contact with un upper area of the primary lining at 24 supports points. The system controller would assure that the load at each of the support points would not exceed the permissible load, preferably 40 metric tons.

With the above described structure, the formwork system of the invention accomplishes, at least, the following advantages and features:

- high speed of work execution, lower costs construction and increased security;
- reduce company's resources allocated to the work;
- unique solution on the market capable of providing a comprehensive solution the client's demand, both in the typology of work of hydraulic works, lines of high speed, metropolitan underground transport infrastructures (subway), etc;
- introduction of new IT technologies for sensorization in the process of building technology.

BRIEF DESCRIPTION OF THE DRAWINGS

Preferred embodiments of the invention are henceforth described with reference to the accompanying drawings, wherein.

PREFERRED EMBODIMENT OF THE INVENTION

Figure 1:
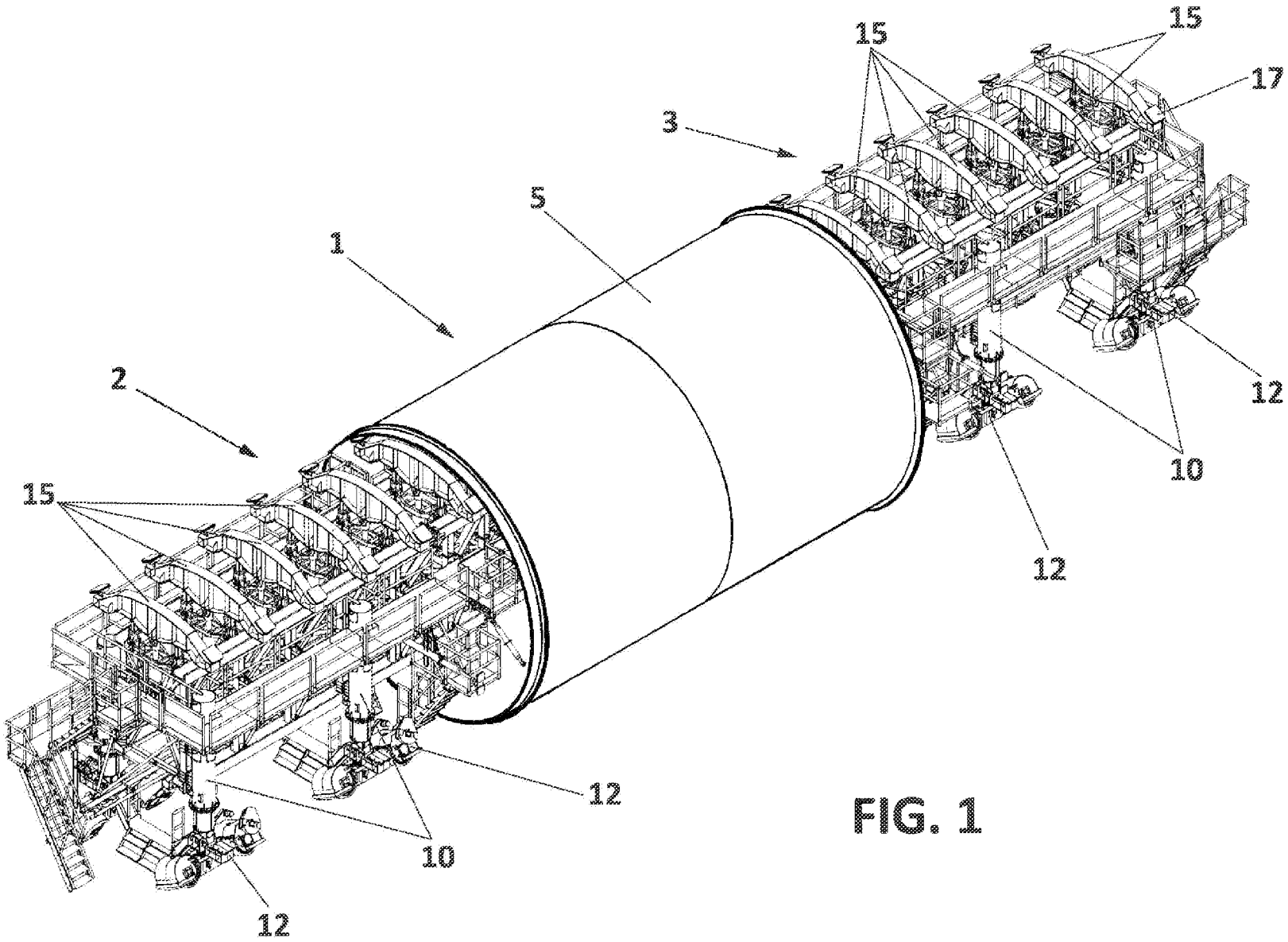
FIG. 1.—shows a perspective view of a full round formwork system according to the invention.
Figure 2:
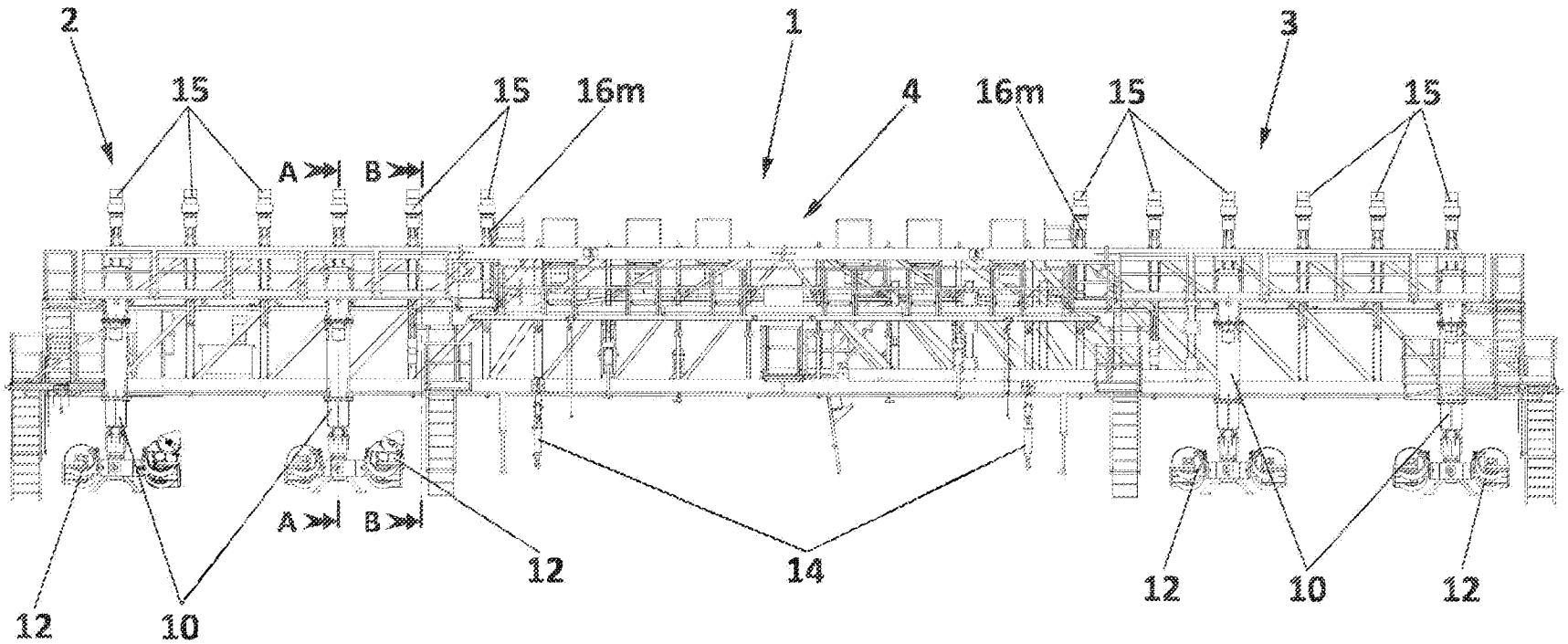
FIG. 2.—shows a side elevational view of the system of FIG. 1 without the tubular formwork.

FIG. 1 shows a formwork system (1) according to the invention, comprising carriage formed by a front structure (2) and a rear structure (3), and a formwork supporting structure (4) arranged in between the first and second structures (2, 3) and attached to the first and second structures (2, 3). First and second structures (2, 3) and the formwork supporting structure (4), are longitudinally aligned so as to move together along a tunnel.

Figure 7:
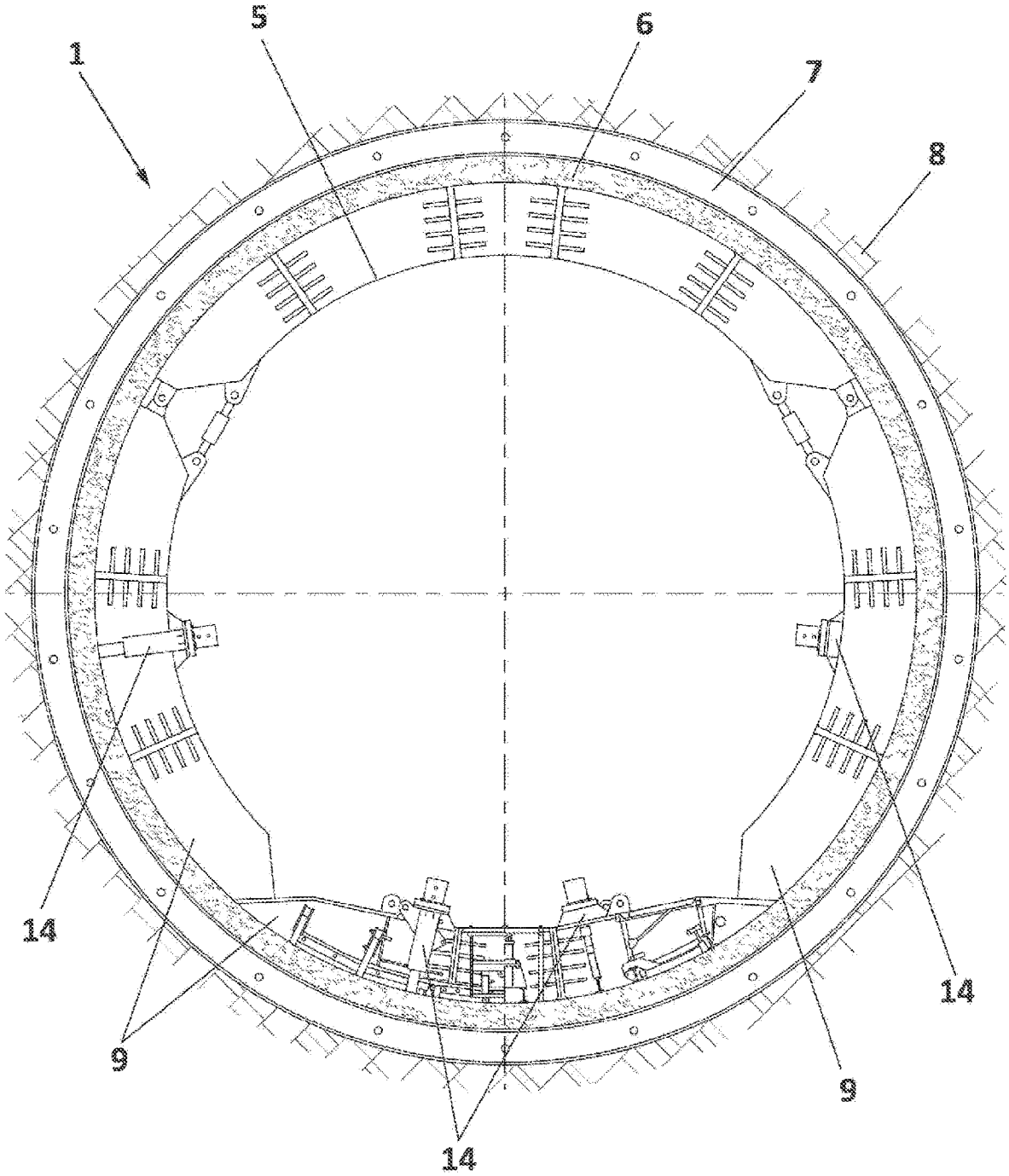
FIG. 7.—shows a cross-sectional view of the formwork in a deployed position while casting a secondary lining inside a tunnel.

A formwork structure (5) is mounted on the formwork supporting structure (4), so that the formwork structure (5) can be transported from one casting position to the next casting position by the front and rear structures (2, 3) for constructing a secondary lining (6) on a primary lining (7) of a tunnel as shown in FIG. 7.

Also as shown in FIG. 7, the formwork structure (5) is formed by a plurality of articulated formwork elements (9), that can be retracted and extended, in a way that when the formwork is placed inside a tunnel and it is extended, it conforms a substantially cylindrical molding surface that defines a cylindrical gap with respect to the primary lining for forming a reinforced secondary lining (6).

The formwork system (1) incorporates a plurality of hydraulic cylinders (14) coupled to some formwork elements (9), and a plurality of pressure sensors, for measuring pressure exerted by the hydraulic cylinders (14) on a primary lining (7).

The front structure and the second structure (2, 3) are provided with four legs (10) each one individually operated by a hydraulic cylinder (11), so that each leg is individually extendable and retractable.

The system further comprises a system controller (not shown), for example implemented as a one or more Programmable Logic Control (PLC) device, that is adapted to maintain the pressure exerted by the legs (10) and the pressure exerted by the hydraulic cylinders (14) on the primary lining (7), below a predefined pressure.

Preferably, the predefined pressure is within the range 40 to 45 metric tons.

Figure 3:
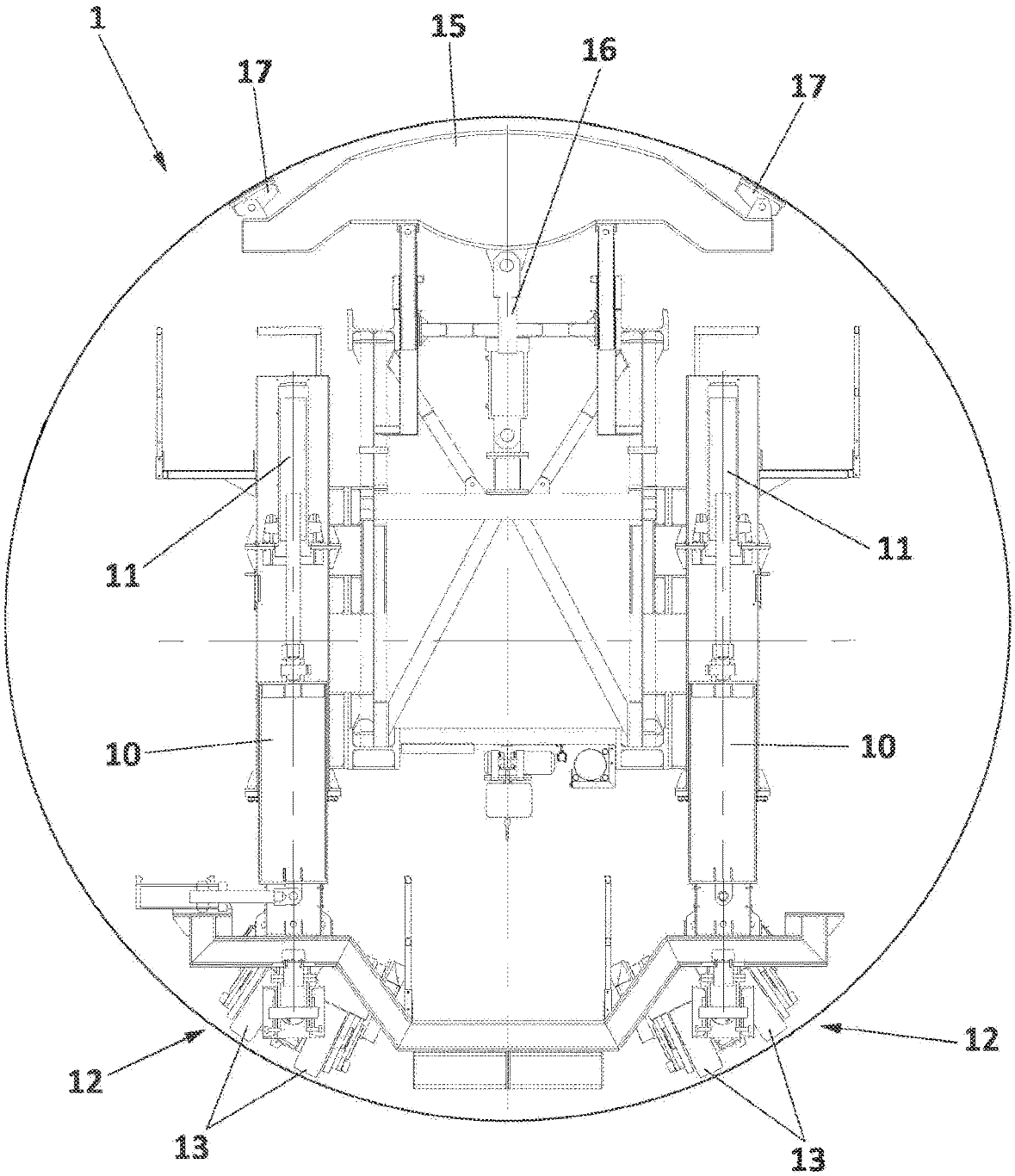
FIG. 3.—shows a cross-sectional view taken at plane A-A in FIG. 2.
Figure 4:
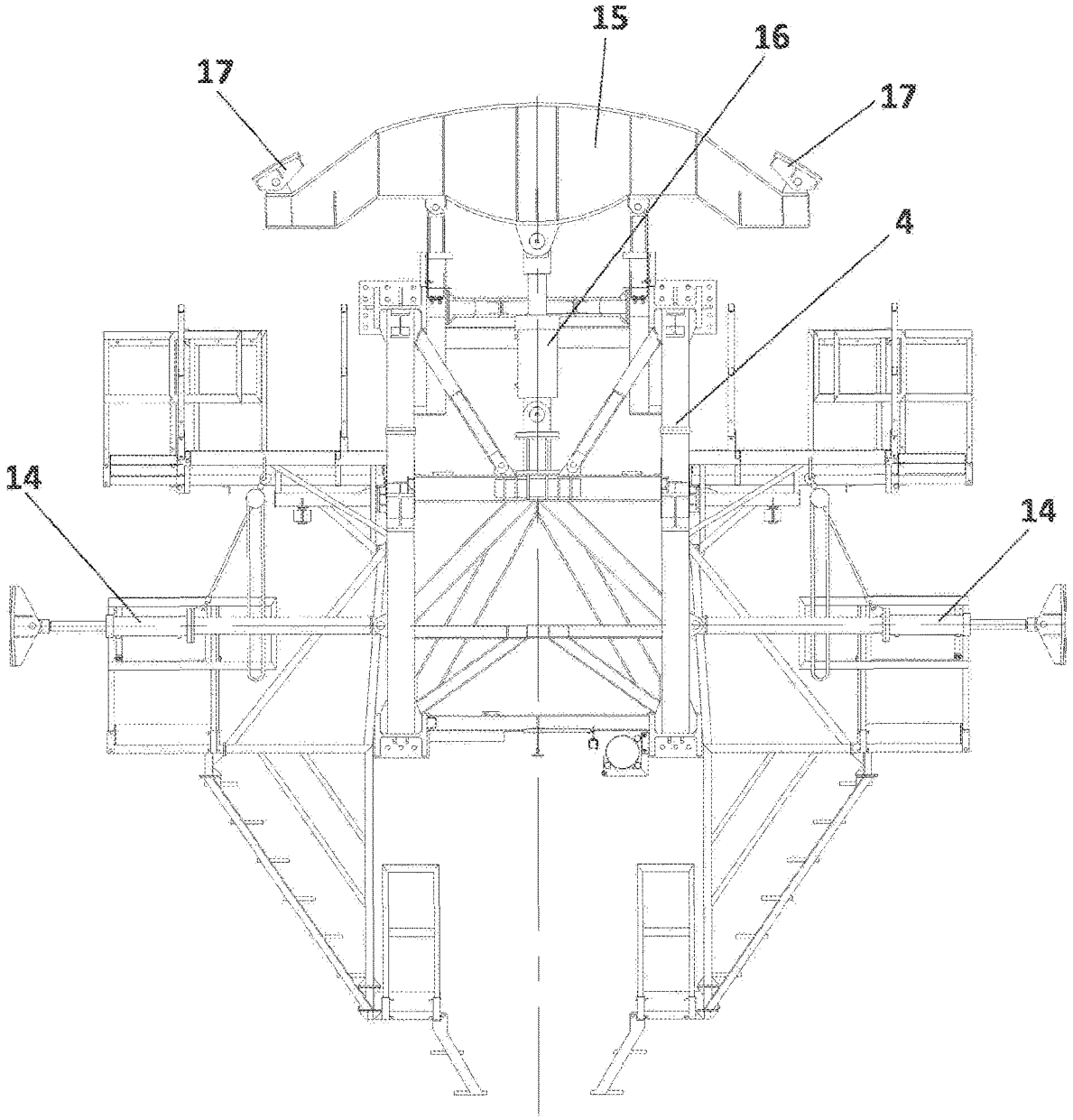
FIG. 4.—shows a cross-sectional view taken at plane B-B in FIG. 2.
Figure 5:
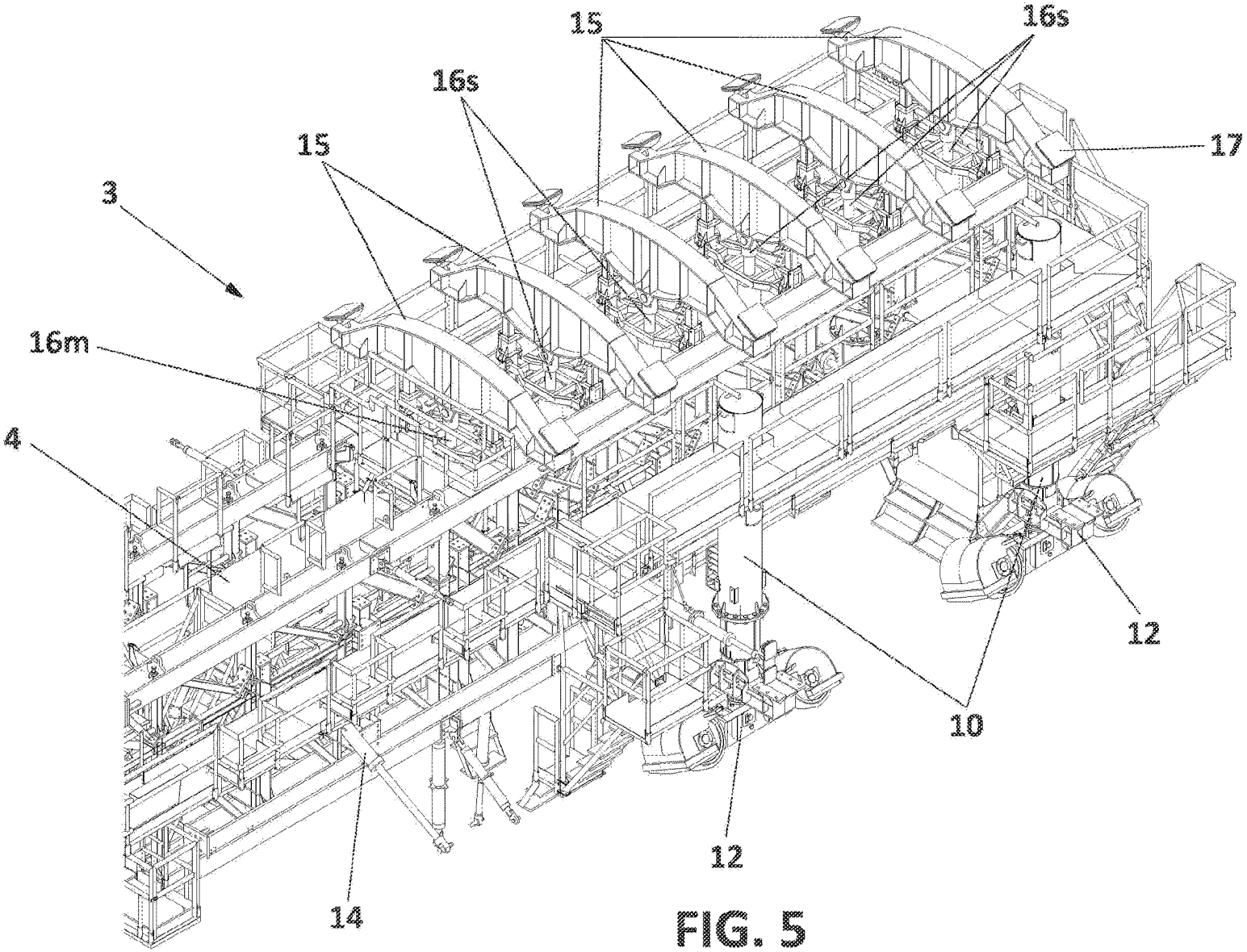
FIG. 5.—shows an enlarged view of the rear structure of FIG. 1.
Figure 6:
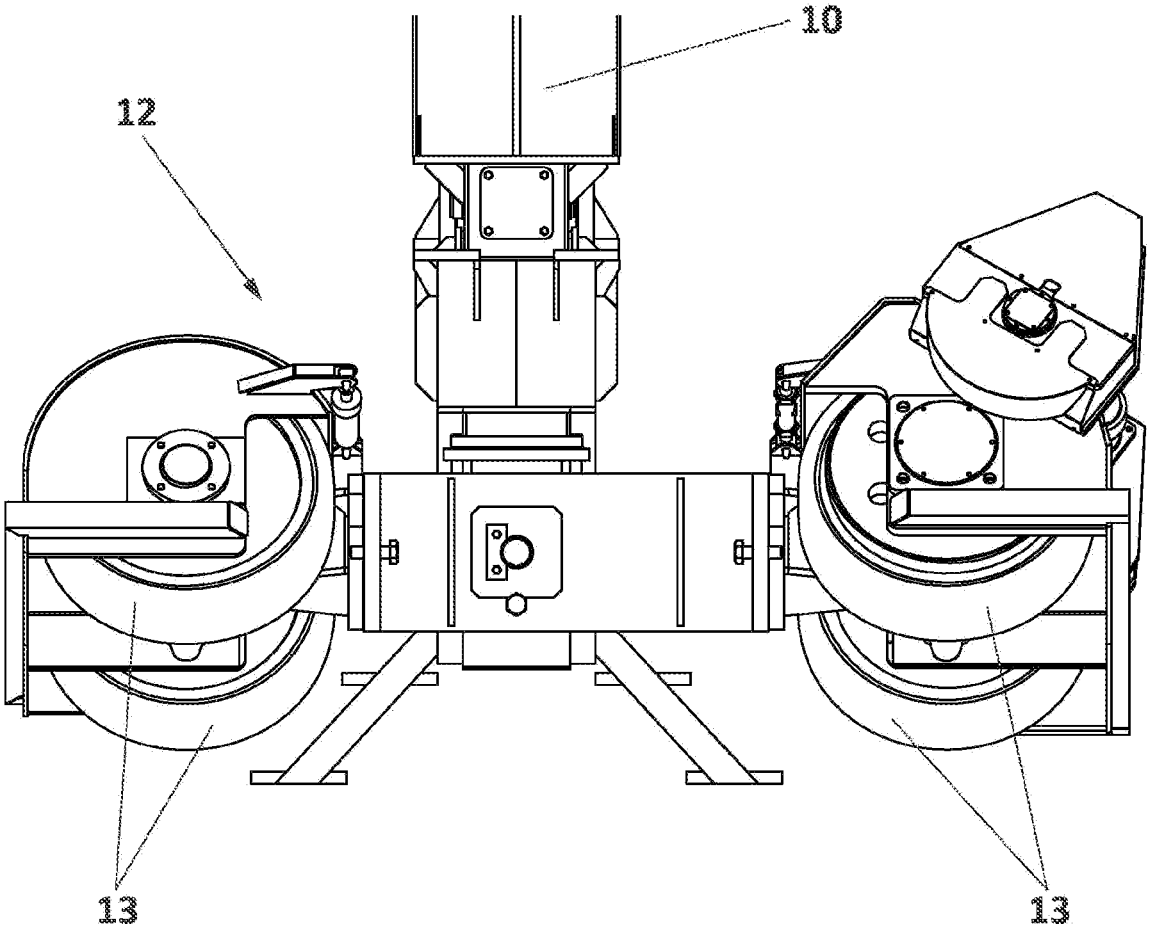
FIG. 6.—shows an enlarged view in perspective of one of the four-wheels bogie.

Each leg (10) is supported by on a four-wheels bogie (12), such that each bogie has a front pair of wheels and a rear pair of wheels, and the wheels in each pair are slightly inclined with respect to each other, as it can be noted for example in FIG. 3 in order for the structures (2, 3) to be able to roll on the cylindrical surface of a primary lining (7) as shown in FIG. 7. All the wheels (13) or some of them, are driving wheels driven by a hydraulic engine.

In other preferred embodiments, the bogie (12) has only one wheel or two wheels.

Therefore, the whole assembly formed by the structures (2, 3), supporting structure (4) and formwork (5), move together on the wheels that roll on a cylindrical surface of the primary lining (7).

As shown in FIG. 3, each leg (10) is arranged as a secant line to a circumference defined by the formwork structure (5) when it is extended. The rotation axis of each wheel (13) is inclined with respect to the longitudinal axis of the leg (10) to which it is coupled, in a way that the wheels (13) can roll on non-coplanar surfaces, for example surfaces that are part of a cylindrical surface.

The front and rear structures (2, 3) are provided with a plurality of arched beams (15), in particular six for each structure, mounted at a top part of the structures, and wherein each arched beam (15) is operated by an anti-flotation hydraulic cylinder (16). Each arched beam (15) has two lateral support shoes (17) that are pivotally mounted in the arched beam, and which are provided for contacting with the primary lining, such that the formwork system would contact with un upper area of the primary lining at 24 supports points The system controller is also adapted to control the anti-flotation hydraulic cylinders (16), to assure that the load applied to the primary lining does not exceed the maximum allowed.

During the load controlling process, the two anti-flotation cylinders (16*m*) of each structure (2, 3) closer to the formwork structure (5), are operated as master cylinders whereas the rest of cylinders (16*s*) are operated as slave cylinders, in a way that, first the master cylinders (16*m*) fix their position at the beginning of the concrete pouring, and by locking their position, pressure readings are taken and send to the system controller, which depending on those readings, operate the slave cylinders (16*s*) by injecting or extracting oil from the slave cylinders (16*s*) for each of the front and rear structures.

The formwork system further comprises a monitoring system adapted to record data relative to the loads transmitted by all the hydraulic cylinders mentioned above, to the primary lining during the casting process.

Other preferred embodiments of the present invention are described in the appended dependent claims and the multiple combinations of those claims.

The invention claimed is:

1. A formwork system for full-round secondary lining of tunnels, the formwork system comprising:

a formwork structure which can be retracted and extended, the formwork structure including a set of formwork elements for casting a closed tubular lining, wherein the formwork structure has a closed tubular configuration in its deployed position;

at least one hydraulic cylinder coupled with one formwork element of the set of formwork elements to exert pressure on the formwork element towards a tunnel surface;

at least one pressure sensor for measuring the pressure exerted by the hydraulic cylinder;

a system controller adapted to operate the hydraulic cylinder pressure based on measurements of the pressure sensor, wherein the system controller is adapted to maintain the pressure exerted by the formwork element on the tunnel surface during concrete forging, the pressure being equal to or below a predefined pressure to avoid damaging an external tunnel lining or structure;

a front structure and a rear structure longitudinally aligned with each other, wherein each of the front structure and the rear structure has legs provided with wheels arranged for rolling on a surface of a primary lining of a tunnel; and a formwork supporting structure arranged in between first and second structures and supported by the first and second structures, wherein the formwork structure is mounted on the formwork supporting structure;

wherein the front and rear structures are provided with a plurality of beams mounted at a top part of the front and rear structures, and wherein each beam is coupled with an anti-flotation hydraulic cylinder to press the beams against a surface of a tunnel, as to withstand flotation loads during concrete casting, and wherein the system controller is further adapted to maintain a load exerted by the anti-flotation hydraulic cylinder equal or below the predefined pressure.

2. The formwork system according to claim 1, wherein the predefined pressure is within the range of 40 to 45 metric tons.

3. The formwork system according to claim 1, wherein each of the legs of the front and rear structure is individually extendable and retractable, and wherein the system controller is further adapted to maintain the pressure exerted by the leg on the primary lining below the predefined pressure.

4. The formwork system according to claim 3, further comprising a bogie having at least one pair of wheels.

5. The formwork system according to claim 4, wherein the wheels in each pair are inclined with respect to each other.

6. The formwork system according to claim 5, wherein each leg is arranged as a secant line to a circumference defined by the formwork structure when it is extended, and wherein the rotation axis of each wheel is inclined with respect to the longitudinal axis of the leg to which it is coupled.

7. The formwork system according to claim 6, wherein the inclination of the rotation axis of the wheels is such that all the wheels could roll on non-coplanar surfaces.

8. The formwork system according to claim 4, wherein each bogie is configured to have a freedom of movement along a transversal axis, and along a vertical axis, and along a longitudinal axis.

9. The formwork system according to claim 4, wherein the wheels are driven wheels that can be individually controlled.

10. The formwork system according to claim 1, wherein the beams are configured as arched beams.

11. The formwork system according to claim 1, wherein a load in each leg can be individually regulated to assure that none of the loads in the legs exceed the predefined load.

12. The formwork system according to claim 1, wherein one anti-flotation cylinder is operated as a master cylinder and the other anti-flotation cylinders are operated as slave cylinders, and wherein the system controller is adapted to operate the slave cylinders when a certain pressure is reached in the master cylinder, so that a pressure exerted by the concrete is distributed among the master cylinder and some slave cylinders so as not to exceed a maximum admissible pressure, thus avoiding damage to any element of the primary lining.

13. The formwork system according to claim 1, further comprising a monitoring system adapted to record data relative to the loads transmitted by the formwork system to the primary lining during the casting process.

14. The formwork system according to claim 1, wherein the system controller is at least one Programmable Logic Control (PLC) device.

15. The formwork system according to claim 1, further comprising post-processing means adapted for processing data provided by the system controller, to determine pressures exerted by the concrete based on stored parameters.

16. The formwork system according to claim 1, wherein the formwork structure has a cylindrical configuration in its deployed position.

* * * * *